US005283144A

United States Patent [19]

Ward et al.

[11] Patent Number: 5,283,144

[45] Date of Patent: Feb. 1, 1994

[54] PURIFIED PHOTOGENERATING PIGMENTS

[75] Inventors: Anthony T. Ward, Webster, N.Y.; George Liebermann; Ah-Mee Hor; Giuseppa Baranyi, all of Mississauga, Canada; Donald J. Teney, Rochester, N.Y.

[73] Assignee: Xerox Corporation, Stamford, Conn.

[21] Appl. No.: 939,760

[22] Filed: Sep. 2, 1992

[51] Int. Cl.[5] ..... G03G 5/04

[52] U.S. Cl. ..... 430/71; 430/73; 430/75; 430/76; 430/78; 430/79; 430/80; 430/82; 430/91; 430/96

[58] Field of Search ..... 430/71, 82, 96, 75, 430/73, 91, 79, 80, 76, 78

[56] References Cited

U.S. PATENT DOCUMENTS 4,082,551 4/1978 Steklenski et al. .
4,220,697 9/1980 Wiedemann .
4,265,990 5/1981 Stolka et al. .
4,431,722 2/1984 Takei et al. .
4,555,463 11/1985 Hor et al. .
4,571,371 2/1986 Yashiki .
4,578,334 3/1986 Borsenberger et al. .
4,587,189 5/1986 Hor et al. .
4,882,254 11/1989 Loutfy et al. .
4,921,773 5/1990 Melnyk et al. .

FOREIGN PATENT DOCUMENTS 4031898 8/1991 Fed. Rep. of Germany .

*Primary Examiner*—John Kight, III
*Assistant Examiner*—P. Hampton-Hightower
*Attorney, Agent, or Firm*—Oliff & Berridge

[57] ABSTRACT

A photoreceptor includes a charge generating layer having: 1) a photogenerating pigment purified by sublimation at a pressure not greater than $10^{-3}$ Torr and subsequent condensation of the photogenerating pigment at a temperature less than about 100° C.; and 2) a film-forming binder.

25 Claims, 3 Drawing Sheets

PURIFIED PHOTOGENERATING PIGMENTS

FIELD OF THE INVENTION

The present invention relates to purified photogenerating pigments and processes for preparing and using them. The purified pigments are useful in photoreceptors having charge generating layers.

BACKGROUND OF THE INVENTION

In electrophotography, a photoreceptor containing a photoconductive insulaing layer on a conductive layer is imaged by first uniformly, electrostatically charging its surface. The member is then exposed to a pattern of activiting electromagnetic radiation, such as light. The radiation selectively dissipates the charge in the illuminated area of the photoconductive insulating layer while leaving behind an electrostatic latent image in the non-illuminated area. This electrostatic latent image may then be developed to form a visible image by depositing finely divided toner particles on the surface of the photoconductive insulating layer. The resulting visible image may then be transferred to a support such as paper. This imaging process may be repeated many times with reusable photoconductive insulating layers.

A photoreceptor may exist in a number of forms. For example, the photoreceptor may be a homogeneous layer of a single material or may be a composite of more than one distinct layer. An example of a multilayered photoreceptor may comprise a substrate, a conductive layer, a blocking layer, an adhesive layer, a charge generating layer and a charge transport layer. U.S. Pat. No. 4,265,990 discloses a photoreceptor having at least two electrically operative layers, including a charge generating layer and a charge transport layer.

In multilayered photoreceptors, materials used for each layer preferably have desirable mechanical properties while also providing electrical properties necessary for the function of the device. If the material of one layer of the photoreceptor or a process used to prepare it is changed in an attempt to improve a particular property, e.g., an electrical property, the change may have an adverse effect on other properties, e.g., mechanical properties, such as delamination of one or more layers. Similarly, if the materials comprising the layers or the processes used to prepare and apply the layers are altered, the photoreceptor sensitivity, response and useful life may be affected.

Suitable and economical coating methods used for applying layers in multi-layer photoreceptors include dip coating, roll coating, Meyer bar coating, bead coating, curtain flow coating and vacuum deposition. These exemplary methods are known in the art. Solution coating using any of the above methods is a preferred approach.

Known vacuum deposition processes are useful in applying charge generating material to an underlying substrate to form a charge generating layer. Conventional photoreceptor devices having vacuum deposited charge generating layers generally have greater photosensitivity than devices having charge generating layers prepared and applied using other known application processes, notably, devices having a charge generating layer comprised of a matrix of resin binder and photogenerating material.

U.S. Pat. Nos. 4,587,189 to Hor et al., 4,882,254 to Loutfy et al. and 4,921,773 to Melnyk at al., the disclosures of which are entirely incorporated herein by reference, disclose charge generating layers, particularly, charge generating layers which have been vacuum deposited.

Improved photoreceptors having an extended electrical life may require a thin charge generating layer, preferably less than 1 μm. In order to assure adequate optical absorption for the charge generating layer in these thin layers, the photogenerating pigment may be dispersed in a polymeric host matrix, but may need to be present at higher concentration than required for photoreceptors having thicker (e.g., 2 μm to 3 μm) photogenerating layers.

U.S. Pat. No. 4,082,551 to Steklenski et al. discloses a photoconductive insulating composition employed in multi-layer elements. The composition may be composed of a wide variety of organic, including organometallic materials in admixture with an electrically insulating film-forming binder material. The disclosed photoconductive compositions are prepared by blending a dispersion or solution of the photoconductive material together with a binder and coating or otherwise forming a layer of such photoconductive composition on an underlying layer. No purification or pretreatment of the photoconductive material is disclosed.

U.S. Pat. No. 4,571,371 to Yashiki discloses an electrophotographic photosensitive member having a charge generating layer and a charge transport layer. A dispersion of charge generating material dissolved in solvent was applied to a cured polyamide resin layer by soaking, and was dried at 100° C. for 10 minutes to form a charge generating layer. Disclosed, exemplary photoconductive materials include phthalocyanine pigment powders and the like, or organic photoconductive materials. No purification or pretreatment of the photoconductive materials is disclosed.

Photogenerating pigments used in charge generating compositions for charge generating layers can be purified to improve photosensitivity of photoreceptor devices. One such purification process involves sublimation of a photogenerating pigment and subsequent condensation of the sublimed pigment. In conventional sublimation apparatus used to purify photoconducting pigments, because a conventional collector is heated both directly by a crucible and by release of heat due to condensation of the purified pigment, the conventional collector undergoes a temperature increase during condensation of the purified pigment.

DE 40 31 898 A1 to Nishiwaki et al. discloses a process for producing and recovering ultrafine particles, such as organic photoconductive particles for electrophotographic photoreceptors, by vapor deposition. In the disclosed process, a particle carrier is moved within a gas phase in a section of a chamber and the ultrafine particles are evaporated by heating the material, which can be vaporized to be laid on a moving carrier. The laid particles are collected while further particles are deposited on another part of the carrier. The deposited particles are collected by a scraper blade, a brush, by suction or by stripping. The material is evaporated at a temperature of more than 80° C. and the particle-charged content is cooled at less than 10° C. The chamber section is evacuated to $10^{-2}$ to $10^{2}$ Torr. The moving carrier is subject to undesirable high temperature effects of conventional sublimation apparatus and the disclosed process is carried out at pressure greater than or equal to $10^{-2}$ Torr.

U.S. Pat. No. 4,220,697 to Wiedemann discloses an electrophotographic recording material comprising a photoconductive layer composed of at least one layer comprising charge carrier-producing and charge transporting compounds. A homogeneous, tightly packed dyestuff layer is achieved by vapor-deposition of the dyestuff on the support under reduced pressure. A vacuum layer between $10^{-3}$ and $10^{-5}$ Torr and heating temperature of between 250° and 400° C. results in vapor deposition without decomposition. The temperature of the support is below 50° C. Charge generating layer dispersions using the vapor-deposited dyestuffs are not disclosed.

U.S. Pat. No. 4,578,334 to Borsenberger et al. discloses multi-active photoconductive insulating elements comprised of a charge generation layer and a charge transport layer. The insulating elements are prepared by 1) depositing, on an electrically-conductive support, a substantially amorphous layer of N,N'-bis(2-phenethyl)-perylene-3,4,9,10-bis(dicarboximide), hereinafter "PPC"; 2) overcoating the substantially amorphous layer with a liquid composition comprising an organic solvent; and 3) effecting removal of the organic solvent from the element. The function of the liquid composition is to (A) form a charge transport layer and (B) to penetrate into the amorphous layer and convert the PPC to crystalline form. Vacuum deposition of the PPC is carried out at a pressure from about $10^{-4}$ to $10^{-6}$ Torr and at a crucible temperature ranging from about 250° C. to 450° C., while maintaining a substrate temperature at or below room temperature. The vacuum-deposited PPC is not crystalline and does not result in a resin dispersed charge generating layer.

U.S. Pat. No. 4,431,722 to Takei et al. discloses a photosensitive element for electrophotography comprised of a layered structure having a polycyclic quinone pigment dispersed in an organic resin binder as a charge generating layer. A commercially available polycyclic quinone is vacuum evaporated for 5 minutes at a temperature of 350° C. and deposited on a substrate disposed 15 centimeters above the evaporation source. The thus prepared pigment is dispersed in a liquid and may be incorporated with a binder resin to improve the mechanical strength and adhesion of the resulting charge generating layer. Vacuum evaporation of the pigment at reduced pressures less than $10^{-3}$ Torr and collection of the sublimed pigment on a cooled substrate are not disclosed.

Conventional photoreceptors, having at least a charge generating layer and charge transport layer and made according to a conventional process, suffer numerous disadvantages. For example, some photoreceptors suffer from poor charge acceptance. Notably, devices manufactured using conventional vacuum deposition processes have vacuum deposited charge generating layers without a resin component, thus resulting in less durable photoreceptors.

SUMMARY OF THE INVENTION

The present invention is directed to a photoreceptor comprising a charge generating layer, the charge generating layer comprising a photogenerating pigment purified by sublimation at a pressure not greater than $10^{-3}$ Torr and condensation of the purified photogenerating pigment at a temperature less than about 100° C. and a film-forming binder, and a process for preparing the photoreceptor devices.

The present invention enables preparation of photoreceptor devices which show an increase in photosensitivity of about 30–50% when compared with conventional photoreceptors.

The invention may be more fully understood with reference to the accompanying drawings and description of preferred embodiments illustrated in the figures. The invention is not limited to the exemplary embodiments but should be recognized as contemplating all modifications within the skill of an ordinary artisan.

DETAILED DESCRIPTION OF PREFERRED EMBODIMENTS

Photoreceptors having a charge generating layer comprising sublimation purified photogenerating pigments are more photosensitive than conventional photoreceptors and have significantly extended useful lives. Specifically, binder-disposed charge generating materials comprising photogenerating pigments purified by sublimation, in which the purified pigment is sublimed at a pressure not greater than $10^{-3}$ Torr and condensed at a temperature less than about 100° C. and dispersed in a film-forming binder, result in a significant increase in photosensitivity for photoreceptors having charge generating layers comprised thereof.

Exemplary temperature ranges less than about 100° C. include, but are not limited to, 10° C. to about 90° C., preferably, not greater than about 60° C. Sublimation pressures are not greater than $10^{-3}$ Torr, preferably not greater than $10^{-4}$ Torr. The sublimation pressure is maintained throughout the sublimation process and is not increased above $10^{-3}$ Torr.

The purified photogenerating pigment may be further processed, for example, by ball-milling, prior to use in charge generating layers according to the invention. Exemplary purified photogenerating pigment particle sizes range from about 0.02 μm to 1.0 μm, preferably, from about 0.02 μm to 0.1 μm.

Exemplary photogenerating pigments which may be purified in a process according to the invention include, but are not limited to, organic photogenerating pigments which can be sublimed, such as phthalocyanines, dibromoanthanthrones or substituted anthanthrones, quinacridones, substituted perylenes, substituted 2,4-diaminotriazines, polynuclear aromatic quinones, and the like. If desired, other suitable, known, photogenerating materials may be utilized.

Preferred phthalocyanines include, but are not limited to, vanadyl phthalocyanine, titanyl phthalocyanine and copper phthalocyanine; preferred dibromoanthanthrones include, but are not limited to, products available from du Pont under the tradenames Monastral Red, Monastral Violet and Monastral Red Y, Vat orange 1 and Vat orange 3. Preferred polynuclear aromatic quinones include, but are not limited to, products available from Allied Chemical Corporation under the tradenames Indofast Double Scarlet, Indofast Violet Lake B, Indofast Brilliant Scarlet and Indofast Orange. Preferred substituted perylenes include, but are not limited to, benzimidazole perylene.

In conventional sublimation purification apparatus, because a conventional collector is heated both directly by the crucible and indirectly by the release of the heat of condensation of the purified pigment, the conventional collector undergoes a temperature increase during condensation of the purified pigment.

Figure 2:
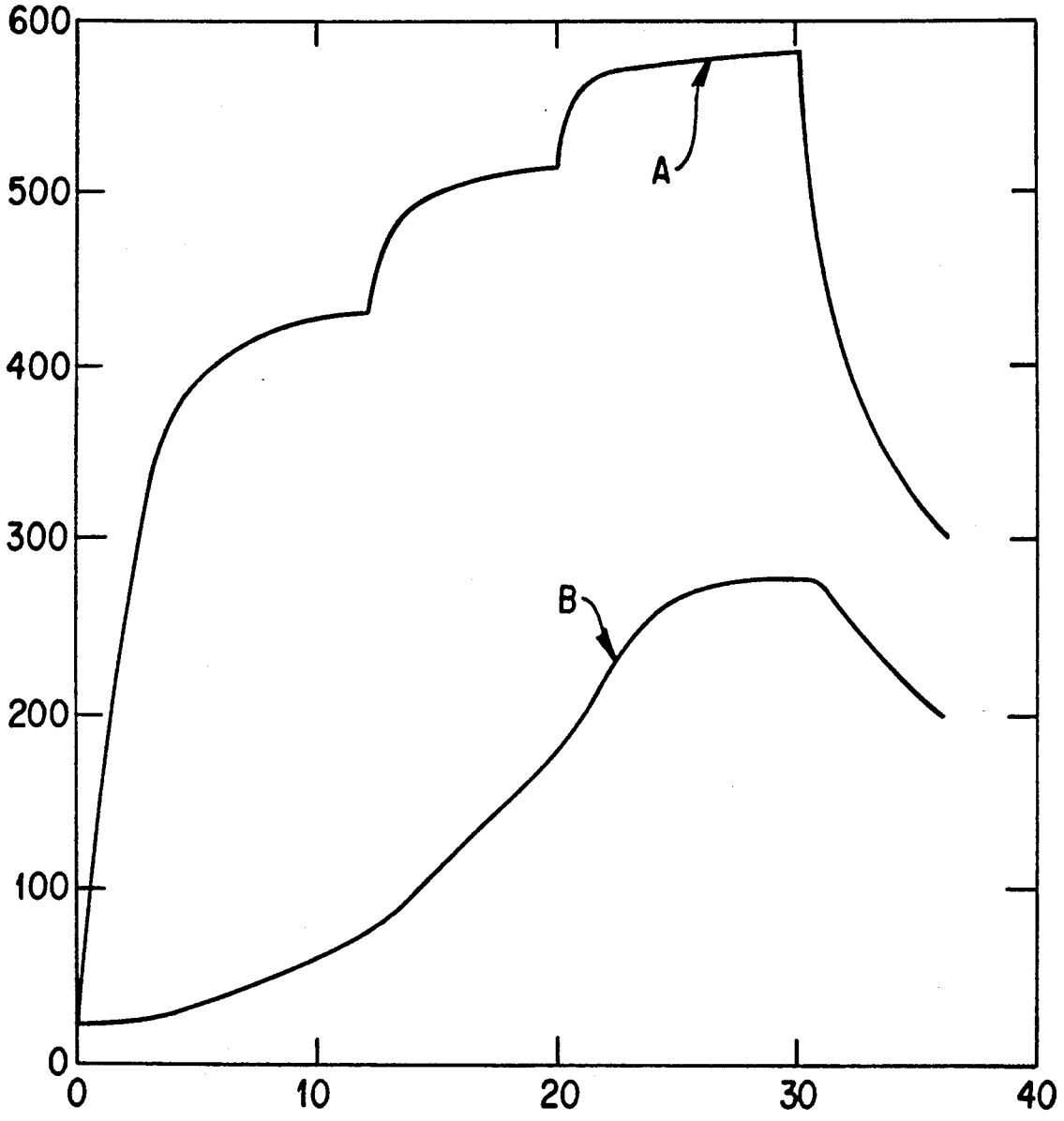
FIG. 2 illustrates temperature/time profiles for a crucible exit slit and collector for a conventional process in which the collector is permitted to reach an equilibrium temperature.

FIG. 2 illustrates temperature/time profiles for a crucible exit slit and collector used in a typical conventional process in which the collector is permitted to reach an equilibrium temperature. In FIG. 2, the crucible operating temperature for this sublimation apparatus is approximately 570° C., as shown in the temperature/time profile A. The crucible operating temperature will depend on the sublimation properties of the particular pigment undergoing sublimation purification. At this temperature, the equilibrium temperature of the collector is approximately 280° C., as shown in the temperature/time profile B.

Figure 1:
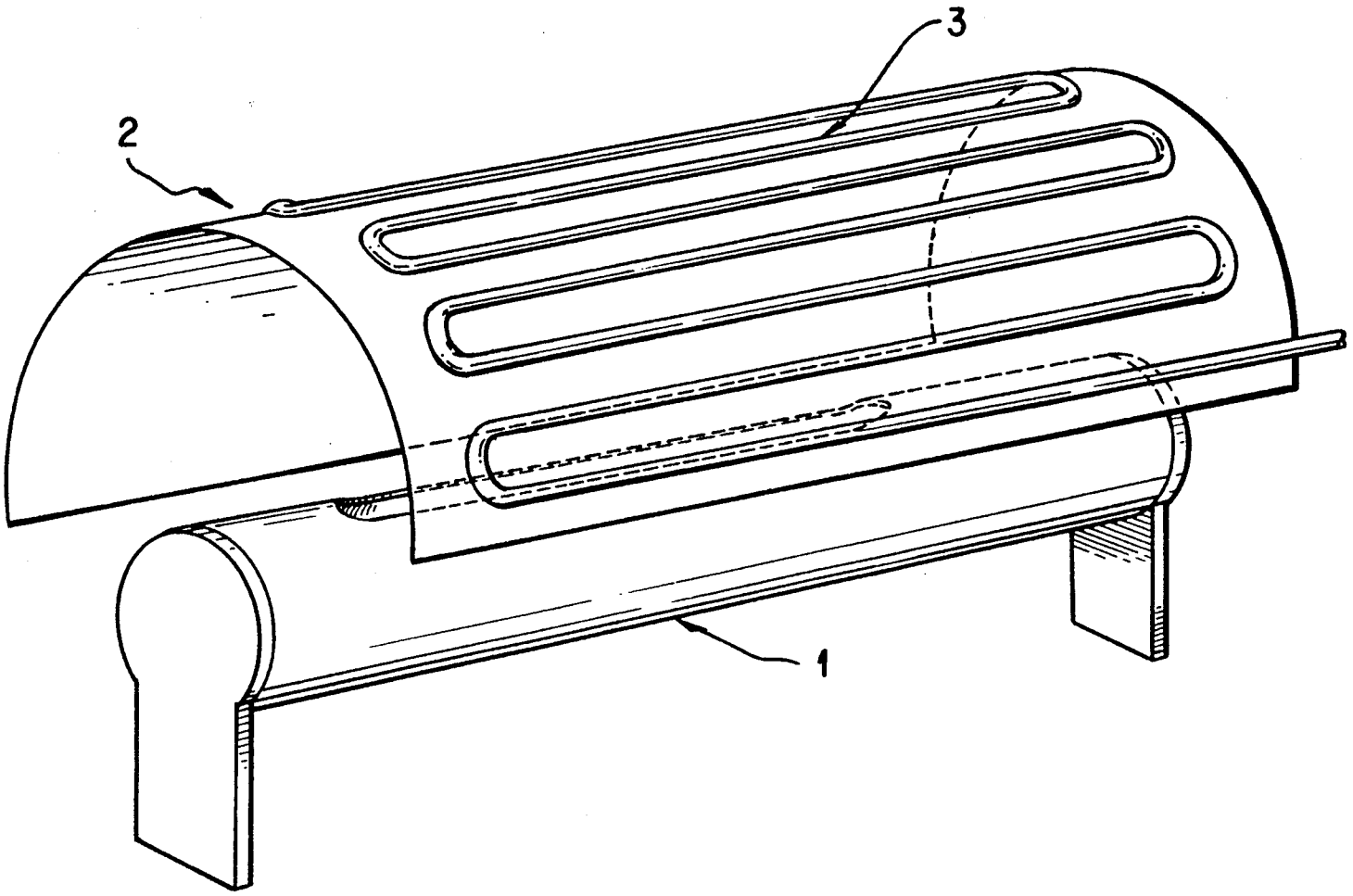
FIG. 1 depicts an embodiment of an apparatus for carrying out a sublimation purification process according to the invention.

In a sublimation purification process according to the invention, an apparatus, illustrated in FIG. 1, having a tube crucible 1, a hemi-cylindrical collector 2 and cooling coils 3, through which cold water is circulated to cool the collector 2, may preferably be used to purify a photogenerating pigment by sublimation and subsequent condensation and collection of the purified pigment.

In an exemplary process, a pigment material is heated in the crucible to a temperature sufficient to sublime the photogenerating pigment at a pressure according to the invention. The collector 2 is maintained at a temperature less than about 100° C. to condense the sublimed, purified photogenerating pigment.

Figure 3:
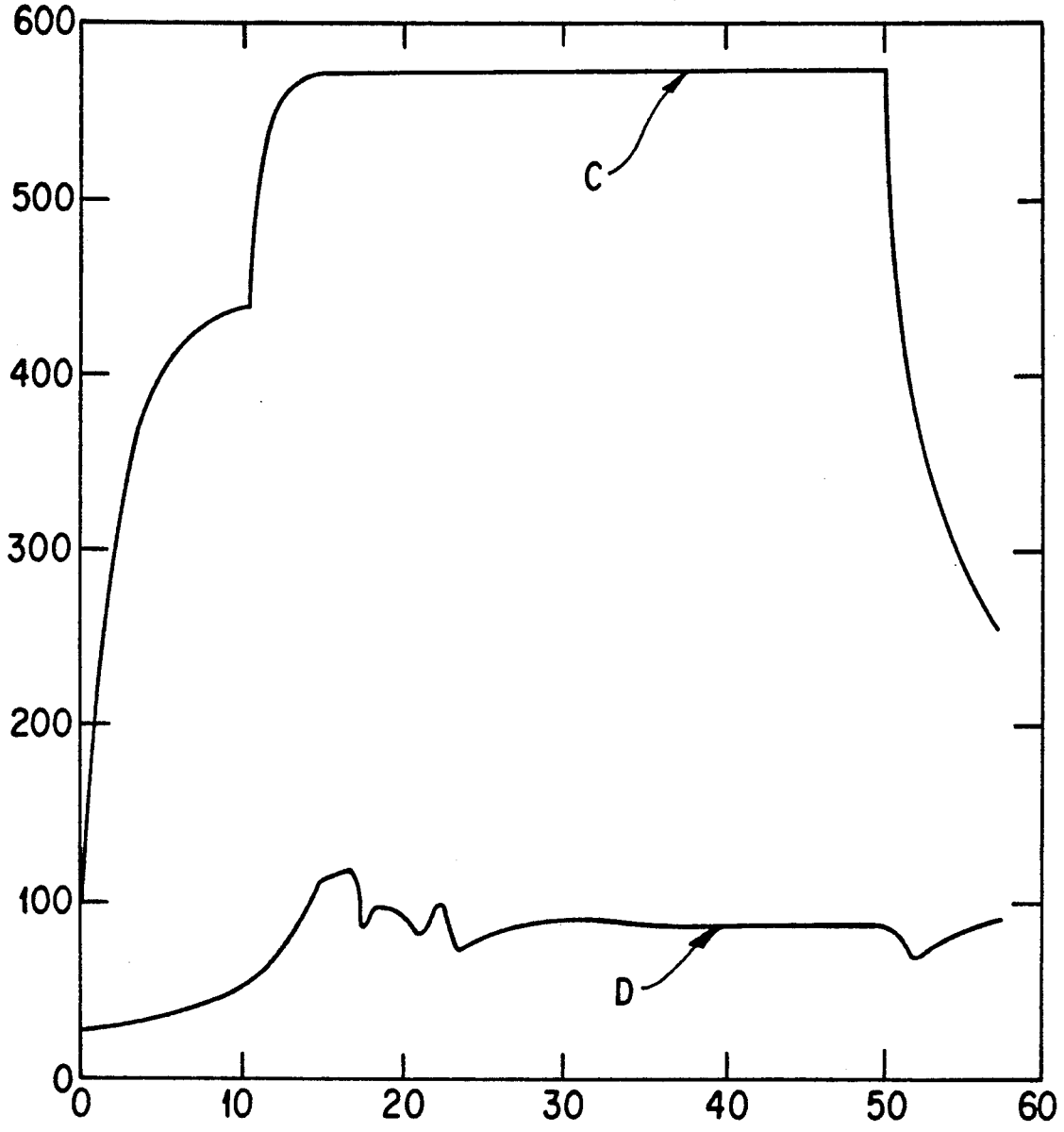
FIG. 3 illustrates temperature/time profiles for a crucible and collector for a sublimation purification process according to the invention, in which the temperature of the collector is held at or below 90° C.

FIG. 3 illustrates corresponding temperature/time profiles for a crucible and collector in a sublimation process according to the invention. In FIG. 3, the operating temperature of the crucible is approximately 570° C., as shown in the temperature/time profile C. In this process, the collector temperature is actively controlled so as to prevent it from exceeding 90° C., as shown in the temperature/time profile D.

Preferred alternatives for maintaining the collector at a temperature below about 100° C. include, but are not limited to: 1) increasing the separation distance between the crucible and collector to reduce the incident intensity of the heat radiated from the crucible; 2) reducing the radiative emission of the crucible by applying a permanent reflective coating onto the surface of the crucible (e.g. a ceramic or inert metal or metal alloy); 3) actively cooling the collector by circulating a cooling liquid through a cooling element in contact with a collector surface which is not exposed to the source crucible; 4) thermoelectric cooling of the collector surface; and 5) any combination of the above.

In a preferred embodiment, copper tubing is welded to a collector surface not exposed to the crucible and cold water is circulated through the system to cool the collector surface to a temperature less than about 100° C. FIG. 3 illustrates temperature/time profiles obtained using this preferred embodiment.

Upon condensation of the sublimed, purified pigment in a sublimation purification process according to the invention, the sublimed, purified pigment is collected and may be used in film-forming binder compositions applied as charge generating layers in photoreceptors.

A representative photoreceptor may include a supporting substrate, optional adhesive layer(s), a conductive layer, a blocking layer, a charge generating layer, and a charge transport layer. Other combinations of layers suitable for use in photoreceptors are also within the scope of the invention. For example, an anti-curl backing layer and/or a protective overcoat layer may also be included, and/or the substrate and conductive layer may be combined. Additionally, a ground strip may be provided adjacent the charge transport layer at an outer edge of the imaging member. The ground strip is coated adjacent to the charge transport layer so as to provide grounding contact with a grounding device.

The substrate, conductive layer, blocking layer, adhesive layer(s), and charge transport layer, if incorporated into a photoreceptor according to the present invention, may be prepared and applied using conventional materials and methods.

The substrate may be opaque or substantially transparent and may comprise numerous suitable materials having the required mechanical properties. The substrate may further be provided with an electrically conductive surface. Accordingly, the substrate may comprise a layer of an electrically non-conductive material such as an inorganic or an organic composition. As electrically non-conducting materials, there may be employed various resins known for this purpose including, but not limited to, polyester, polycarbonates, polyamides, polyurethanes, and the like. The substrate may have any number of different configurations such as, for example, a sheet, a scroll, a drum, an endless flexible belt, and the like.

The surface of the substrate layer is preferably cleaned prior to coating to promote greater adhesion of a deposited, conductive coating. Cleaning may be effected by exposing the surface of the substrate layer to plasma discharge, ion bombardment and the like.

An electrically conductive layer may be formed on the surface by any suitable coating technique, such as vacuum deposition. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member.

A blocking layer may be applied to the electrically conductive layer. The blocking layer may include polymers such as polyvinylbutyral, epoxy resins, polyesters, polysiloxanes, polyamides, polyurethanes and the like, or may be nitrogen-containing siloxanes or nitrogen-containing titanium compounds.

An intermediate adhesive layer between the blocking layer and the charge generating or photogenerating layer may be desired to promote adhesion. Typical adhesive layers include film-forming polymers such as polyester, du Pont 49,000 resin (available from E. I. du Pont de Nemours & Co.), Vitel PE-100 (available from Goodyear Rubber & Tire Co.), polyvinylbutyral, polyvinylpyrrolidone, polyurethane, polymethyl methacrylate, and the like. Both the du Pont 49,000 and Vitel PE-100 adhesive layers are preferred because they provide reasonable adhesion strength and produce no deleterious electrophotographic impact on the resulting imaging members.

Using any conventional process previously discussed, each of the above-described layers may be applied and dried before applying each successive layer. Generally, the cumulative thickness of the layers in a multi-layered photoreceptor does not exceed 40 micrometers.

A photoreceptor according to the present invention comprises a charge generating layer which contains a sublimation purified photogenerating pigment, which photogenerating pigment has been sublimed at a pressure not greater than $10^{-3}$ Torr and then condensed at a condensation temperature less than about 100° C., and a film-forming binder. Any suitable photogenerating pigment prepared in accordance with the inventive sublimation purification process may be applied to a substrate or another layer in the photoreceptor. The charge generating layer of the present invention contains at least one of the aforementioned photogenerating pigments dispersed in a film-forming binder resin. The resulting dispersion may preferably be mixed with a solvent before applying the charge generating layer to the photoreceptor.

Because of their sensitivity to white light, photogenerating pigments such as vanadyl phthalocyanine, metal free phthalocyanine, benzimidazole perylene and the like, and mixtures thereof, are preferred in photoreceptors having charge generating layers. Vanadyl phthalocyanine and metal free phthalocyanines are preferred because these materials are also sensitive to infrared light.

Any suitable polymeric film-forming binder material may be employed as a matrix in the charge generating layer. The binder polymer preferably 1) adheres well to the substrate or other underlying layer; and 2) dissolves in a solvent. Examples of materials useful as the film-forming binder include, but are not limited to, polyvinylcarbazole, phenoxy resin, polycarbonate, polyvinylbutyral, polystyrene, polystyrenebutadiene and polyester. Other suitable binder polymers are also known in the art.

Solvents used for the charge generating compositions of the invention should dissolve the film-forming binder of the charge generating layer and disperse the photogenerating pigment particles present in the charge generating composition. Examples of typical solvents include, but are not limited to, monochlorobenzene, tetrahydrofuran, cyclohexanone, methylene chloride, 1,1,1-trichloroethane, 1,1,2-trichloroethane, dichloroethylene, 1,2-dichloroethane, toluene, and the like, and mixtures thereof. Mixtures of solvents may be utilized to control evaporation rate. For example, satisfactory results may be achieved with a tetrahydrofuran to toluene ratio of between about 90:10 and about 10:90 by weight.

Preferably, the combination of photogenerating pigment, binder polymer and solvent should form uniform dispersions of the photogenerating pigment in the charge generating composition. Examples of charge generating layer combinations include, but are not limited to, benzimidazole perylene, polycarbonate and methylene chloride; vanadyl phthalocyanine, polyvinylcarbazole, and tetrahydrofuran; and vanadyl phthalocyanine, polycarbonate and methylene chloride.

Generally, from about 5 percent by volume to about 95 percent by volume of the photogenerating pigment is dispersed in no more than about 95 percent by volume of the film-forming binder. In one embodiment, a volume ratio of the photogenerating pigment and film-forming binder is about 1:12, corresponding to about 8 percent by volume of the photogenerating pigment dispersed in about 92 percent by volume of the film-forming binder. In another embodiment, the volume ratio of the film-forming binder and photogenerating pigment is about 1:4, corresponding to about 80 percent of the photogenerating pigment dispersed is about 20 percent binder.

Any suitable technique may be utilized to mix and thereafter apply the charge generating layer composition to the substrate or previously dried underlying layer. Typical application techniques include spray coating, dip coating, roll coating, Meyer bar coating, bead coating, curtain flow coating and the like.

Exemplary charge generating layer thicknesses according to the present invention include, but are not limited to, thicknesses ranging from about 0.1 μm to about 5.0 μm, and preferably from about 0.3 μm to about 2.0 μm. Charge generating layer thickness generally depends on film-forming binder content. Higher binder content generally results in thicker photogeneration layers. Thicknesses outside the above exemplary ranges are also within the scope of the invention.

A photoreceptor according to the present invention may also include a charge transport layer comprising any suitable organic polymer or non-polymeric material capable of transporting charge to selectively discharge the surface charge. The charge transport layer is preferably transparent. It may not only serve to transport charges, but may also protect the imaging member from abrasion, chemical attack and similar destructive elements, thus extending the operating life of the photoreceptor. Alternatively, or in addition, a protective overcoat layer may provide these protective functions.

The charge transport layer should exhibit negligible, if any, discharge when exposed to a wavelength of light useful in xerography, e.g. 4000 Angstroms to 9000 Angstroms. Therefore, the charge transport layer is substantially transparent to radiation in a region in which the photoreceptor operates.

Charge transport materials for use in the present invention are preferably compositions comprising a hole transporting material dispersed in a resin binder and dissolved in a solvent for application.

Hole transporting materials for use in compositions according to the present invention include, but are not limited to, a mixture of one or more transporting aromatic amines. Exemplary aromatic amines include triaryl amines such as triphenyl amines, poly triaryl amines, bisarylamine ethers and bisalkylaryl amines.

Preferred bisarylamine ethers include, but are not limited to, bis(4-diethylamine-2-methylphenyl)-phenylmethane and 4'-4''-bis(diethylamino)-2',2''-dimethyltriphenylmethane. Preferred bisalkylaryl amines include, but are not limited to, N,N'-bis(alkylphenyl)-(1,1'-biphenyl)-4,4'-diamine wherein the alkyl is, for example, methyl, ethyl, propyl, n-butyl, and the like. Meta-tolyl-bis-diphenylamino benzidine and N,N'diphenyl-N,N'-bis(3''-methylphenyl)-(1,1'biphenyl)-4,4'-diamine are preferred transporting aromatic amines.

Exemplary resin binders used in charge transport compositions according to the present invention include, but are not limited to, polycarbonate resin, polyvinylcarbazole, polyester, polyarylate, polyacrylate, polyether and polysulfone. Molecular weights of the resin binders can vary from about 20,000 to about 1,500,000.

Preferred resin materials are polycarbonate resins having molecular weights from about 20,000 to about 120,000, more preferably from about 50,000 to about 100,000. Highly preferred resin materials are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; polycarbonate resin having a molecular weight of from about 50,000 to about 100,000, available as Makrolon from Farben Fabricken Bayer A.G.; polycarbonate resin having a molecular weight of from about 20,000 to about 50,000 available as Merlon from Mobay Chemical Company; polyether carbonates; and 4,4'-cyclohexylidene diphenyl polycarbonate.

Solvents useful to form charge transport layers according to the present invention include, but are not limited to, monochlorobenzene, tetrahydrofuran, cyclohexanone, methylene chloride, 1,1,1-trichloroethane, 1,1,2-trichloroethane, dichloroethylene, toluene, and the like. Methylene chloride is a desirable component of the charge transport layer coating mixture for adequate dissolving of all the components and for its low boiling point.

A preferred charge transport layer material for multilayer photoconductors comprises from about 25 percent to about 75 percent by weight of at least one charge transporting aromatic amine, and about 75 percent to about 25 percent by weight of a polymeric film-forming resin in which the aromatic amine is soluble.

The invention will further be illustrated in the following examples, it being understood that these examples are illustrative only and that the invention is not limited to the materials, conditions, process parameters and the like recited therein.

EXAMPLES

Comparative Example

To a crucible in a conventional sublimation apparatus, 300 grams of pelletized benzimidazole perylene are added for purification by sublimation. A chamber containing the apparatus is evacuated to $10^{-4}$ Torr. The tubular crucible is heated to above 500° C., at which temperature the sublimation of pelletized benzimidazole perylene commences. The hemi-cylindrical metal collector positioned statically above the crucible exit slit serves to condense the benzimidazole perylene vapor, sublimed from the source material in the crucible. The collector, heated both directly by the crucible and by the release of the heat of condensation of the collected benzimidazole perylene, is not cooled and is permitted to reach its equilibrium temperature of 280° C. FIG. 2 represents the temperature/time profile for the crucible exit slit (curve A) and the collector (curve B).

After 10 minutes, the crucible heat source is discontinued and the sublimed benzimidazole perylene condensing on the collector is scraped from the collector and discarded.

The pelletized benzimidazole perylene is then reheated, under vacuum at $10^{-4}$ Torr, to the same operating temperature (above 500° C.) and the collector is again allowed to reach its normal equilibrium temperature. The sublimed, purified benzimidazole perylene condenses on the collector and, upon cooling, is subsequently collected for use in preparing a charge generating composition.

Two samples of the charge generating composition are prepared by ball-milling two different compositions (for 1 and 4 days, respectively) containing 80 parts by volume of the collected, purified benzimidazole perylene with 20 parts by volume of Makrolon® polycarbonate and an amount of methylene chloride solvent sufficient to obtain a 1.25% to 6.0% solids content.

The resulting charge generating compositions are applied to three separate standard metallized polyethylene terephthalate substrates. The substrates are precoated with known blocking and adhesive interface layers. The charge generating compositions are applied to form a charge generating layer by known draw-bar coating techniques to obtain a thin film of the benzimidazole perylene dispersion (0.4 μm and 0.8 μm thicknesses).

Two devices are prepared using the composition ball-milled for one day. One device has a benzimidazole perylene layer 0.4 μm thick and the other, 0.8 μm thick. A single device having a 0.4 μm thick layer is prepared using the composition which has been ball-milled for four days. The photoreceptor devices are completed by draw-bar coating, over the dispersed benzimidazole perylene layer, a 29 μm charge transport layer of 50 wt. % meta-tolyl-bis-diphenylamino benzidine in Makrolon® polycarbonate, again dissolved in methylene chloride.

The resulting photoreceptor devices are subjected to xerographic electrical evaluation in a cycling scanner. In these xerographic evaluation tests, the samples are taped to the surface of a cylindrical drum which is rotated so that the samples pass successively under a corona charging device, an exposure station delivering a controlled white light exposure, an erase lamp and a series of electrometer probes. These probes measure the surface electrostatic potential of the devices and are positioned: 1) immediately downstream from the charging station; 2) at a location downstream from the exposure station nominally corresponding to the position of xerographic development; and 3) immediately after the erase lamp. The electrical results are tabulated in Table 1. In Table 1, Vddp is the surface potential at the second electrometer probe in the absence of white light exposure. Vbg 3.8 ergs and Vbg 5.0 ergs are the potentials measured at the same probe after white light exposures of 3.8 ergs/cm$^2$ and 5.0 ergs/cm$^2$, respectively. The electrical results are tabulated and reported in Table 1.

EXAMPLE 1

The procedure described in the Comparative Example for obtaining purified condensed benzimidazole perylene is repeated except that, upon reheating of the pelletized benzimidazole perylene, the collector is maintained at a temperature of 90° C. by circulating cold water through cooling coils which have been welded to a surface not exposed to the crucible outlet (as illustrated in FIG. 1). FIG. 3 represents the time/temperature profile for the crucible (curve C) and collector (curve D) in which the temperature of the collector is maintained at 90° C. throughout the sublimation and condensation processes.

As in the Comparative Example, the condensed benzimidazole perylene is collected and three photoreceptor devices prepared. The resulting photoreceptor devices are subjected to xerographic electrical evaluation in a cycling scanner and the results reported in Table 1.

EXAMPLE 2

The procedure in Example 1 is repeated except that, upon reheating, the collector is maintained at a temperature of 75° C.

Three photoreceptor devices are prepared in accordance with the procedure in Example 1 and the resulting devices subjected to xerographic electrical evaluation in a cycling scanner. Electrical results are shown in Table 1.

EXAMPLE 3

The procedure in Example 1 is repeated, except that after the first 10 minutes of collection of the sublimed pigment, the collector is rotated away using a mechanical device, without discontinuing the crucible heat source. The sublimation is continued on a second collector, previously shielded from exposure to the sublimation path by the first collector, now rotated away. This second collector is maintained at 50° C. by circulating cold water through cooling coils which have been welded to a surface not exposed to the crucible outlet as represented in FIG. 1. Three photoreceptor devices are prepared in accordance with the procedure in the Example 1 and the resulting devices subjected to xerographic electrical evaluation in a cycling scanner. The results are reported in Table 1.

The difference (Vddp−Vbg) between the dark development potential and the background potential after exposure is a measure of the electrostatic latent image contrast available for development by toner particles to form a visible image. The mass of toner per unit area in the developed visible image (which determines the perceived reflective optical density of the image) is proportional to the magnitude of (Vddp−Vbg). Inspection of Table 1 entries for dark development potential (Vddp) and background potential after white light exposure to 3.8 ergs/cm$^2$ (Vbg 3.8 ergs) and 5.0 ergs/cm$^2$ (Vbg 5.0 ergs) reveals that Examples 1, 2 and 3 devices outperform the Comparative Example devices. The above results for xerographic sensitivity and dispersion time verify the advantages of sublimation purification of benzimidazole perylene onto a cool condensing collector.

Another feature common to both the results for Examples 1–3 is that precoat milling of the dispersion for four days rather than one day does not greatly improve the xerographic properties of the final device. Sublimed benzimidazole perylene collected on a cooled substrate provides photoreceptors having greater sensitivity regardless of the milling time used in preparing the charge generating layer according to the invention.

What is claimed is:

1. A photoreceptor comprising a charge generating layer, the charge generating layer comprising: 1) a photogenerating pigment purified by sublimation at a sublimation pressure not greater than $10^{-3}$ Torr and subsequent condensation at a condensation temperature less than about 100° C.; and 2) a film-forming binder.

2. The photoreceptor according to claim 1, wherein the photogenerating pigment is an organic photoconductive material which can be sublimed.

3. The photoreceptor according to claim 2, wherein the organic photoconducting material is selected from the group consisting of phthalocyanines, anthanthrones, substituted anthanthrones, quinacridones, substituted perylenes, substituted 2,4-diaminotriazines and polynuclear aromatic quinones.

4. The photoreceptor according to claim 3, wherein the substituted perylene is benzimidazole perylene.

5. The photoreceptor according to claim 1, wherein the film-forming binder is selected from the group consisting of polyvinylcarbazole, phenoxy resin, polycarbonate, polyvinylbutyral, polystyrene, polystyrenebutadiene and polyester.

6. The photoreceptor according to claim 1, wherein from about 5 percent by volume to about 95 percent by volume of the photogenerating pigment is dispersed in no more than about 95 percent by volume of the film-forming binder.

7. The photoreceptor according to claim 1, wherein the photogenerating pigment and film-forming binder are benzimidazole perylene and polycarbonate.

8. The photoreceptor according to claim 1, wherein the condensation temperature ranges from about 10° C. to about 90° C.

9. The photoreceptor according to claim 1, wherein the condensation temperature is not greater than about 60° C.

10. The photoreceptor according to claim 1, wherein a particle size of the purified photogenerating pigment ranges between about 0.02 μm and 1.0 μm.

11. The photoreceptor according to claim 1, wherein a particle size of the purified photogenerating pigment ranges between about 0.02 μm and 0.1 μm.

12. The photoreceptor according to claim 1, wherein a thickness of the charge generating layer ranges from about 0.1 μm to about 5.0 μm.

13. The photoreceptor according to claim 1, wherein a thickness of the charge generating layer ranges from about 0.3 μm to about 2.0 μm.

14. A process for preparing a photoreceptor device comprising:

TABLE 1

| | | CGL | Cycle 90 | | | | |
|---|---|---|---|---|---|---|---|
| | Mill Time | Thickness (μm) | Vddp | Vbg (3.8 ergs) | % Discharge (3.8 ergs) | Vbg (5.0 ergs) | % Discharge (5.0 ergs) |
| Comparative | 1 day | 0.4 | 991 | 772 | 22.1 | 693 | 30.0 |
| Example | 1 day | 0.8 | 842 | 574 | 31.8 | 487 | 42.2 |
| | 4 day | 0.4 | 996 | 844 | 35.3 | 542 | 45.6 |
| Example 1 | 1 day | 0.4 | 1000 | 603 | 39.7 | 487 | 51.3 |
| | 1 day | 0.8 | 806 | 348 | 56.8 | 235 | 70.8 |
| | 4 day | 0.4 | 959 | 516 | 46.2 | 400 | 58.2 |
| Example 2 | 1 day | 0.4 | 936 | 623 | 33.4 | 531 | 43.2 |
| | 1 day | 0.8 | 714 | 335 | 53.1 | 220 | 69.2 |
| | 4 day | 0.4 | 959 | 572 | 40.4 | 462 | 51.8 |
| Example 3 | 1 day | 0.4 | 1085 | 644 | 40.6 | 532 | 51.0 |
| | 1 day | 0.8 | 814 | 282 | 65.3 | 157 | 80.7 |
| | 4 day | 0.4 | 1027 | 552 | 46.3 | 428 | 58.3 |

subliming a photogenerating pigment at a sublimation pressure not greater than $10^{-3}$ Torr;

condensing the sublimed pigment on a collector at a condensation temperature less than about 100° C.;

dispersing the condensed photogenerating pigment in a film-forming resin and solvent to form a charge generating dispersion;

applying the charge generating dispersion over a substrate; and evaporating the solvent to form a charge generating layer over the substrate.

15. The process according to claim 14, wherein the condensation temperature of the collector is maintained by selection of a distance between the collector and a subliming apparatus.

16. The process according to claim 14, wherein the condensation temperature of the collector is maintained by applying a permanent reflective coating to a heating crucible of a subliming apparatus to reduce radiative emissions.

17. The process according to claim 14, wherein the condensation temperature of the collector is maintained by actively cooling the collector.

18. The process according to claim 17, wherein a cooling element contacts a surface of said collector which is not exposed to a subliming crucible.

19. The process according to claim 14, wherein the photogenerating pigment is an organic photoconductive material.

20. The process according to claim 19, wherein the organic photoconducting material is selected from the group consisting of phthalocyanines, anthanthrones, substituted anthanthrones, quinacridones, substituted perylenes, substituted 2,4-diaminotriazines and polynuclear aromatic quinones.

21. The process according to claim 20, wherein the substituted perylene is benzimidazole perylene.

22. The process according to claim 14, wherein the condensation temperature ranges from about 10° C. to about 90° C.

23. The process according to claim 14, wherein the condensation temperature is not greater than about 60° C.

24. The process according to claim 14, further comprising applying a blocking layer over the substrate prior to applying the charge generating dispersion.

25. The process according to claim 14, further comprising applying a charge transport layer over the charge generating layer.

* * * * *